US005878931A

United States Patent [19]

Morphet

[11] Patent Number: 5,878,931

[45] Date of Patent: Mar. 9, 1999

[54] HALLOWEEN BACKPACK

[75] Inventor: Deborah A. Morphet, Penticton, Canada

[73] Assignee: Macmor-Fun Group Inc., Penticton, Canada

[21] Appl. No.: 14,684

[22] Filed: Jan. 28, 1998

Related U.S. Application Data

[60] Provisional application No. 60/036,631 Jan. 31, 1997.

[51] Int. Cl.[6] ..... A45F 3/04

[52] U.S. Cl. ..... 224/629; 224/645; 224/650; D3/218; 206/457

[58] Field of Search ..... 224/153, 625, 224/627, 629, 645, 646, 650, 651, 191; D3/217, 218; 206/457; 383/36, 907

[56] References Cited

U.S. PATENT DOCUMENTS

| | | | |
|---|---|---|---|
| D. 332,171 | 1/1993 | Gudas et al. | D3/217 |
| 3,888,486 | 6/1975 | Sutter et al. | 383/117 |
| 4,087,031 | 5/1978 | Fenner | 224/627 |
| 4,174,059 | 11/1979 | Mauder . | |
| 4,662,550 | 5/1987 | O'Donnell . | |
| 4,809,893 | 3/1989 | Parsons . | |
| 4,813,556 | 3/1989 | Lawrence | 383/907 |
| 5,190,196 | 3/1993 | Haner, III | 224/625 |
| 5,379,911 | 1/1995 | Goto et al. | 383/907 |
| 5,458,278 | 10/1995 | LaConte | 224/153 |
| 5,467,918 | 11/1995 | Glover | 232/43.1 |
| 5,586,706 | 12/1996 | Ritzenhein | 224/251 |

*Primary Examiner*—Allan N. Shoap
*Assistant Examiner*—Gregory M. Vidovich
*Attorney, Agent, or Firm*—Antony C. Edwards

[57] ABSTRACT

The Halloween backpack of the present invention has, in one aspect, a hollow container having an outer surface adapted to be worn as a backpack on the back of a child, straps for releasable mounting of the hollow container on the back of the child, a hollow chute mounted onto the outer surface of the hollow container, the chute defining a passageway along the chute between a frontal chute opening in the chute and an aperture in the outer surface of the hollow container thereby forming a cooperating passageway sized to accept Halloween treats therethrough cooperating between the frontal opening and a holding cavity in the hollow container, the hollow chute extending upwardly of the hollow container so as to extend above a shoulder of the child when the child is wearing the hollow container as a backpack, the hollow chute shaped to present the frontal chute opening for access from a frontal position facing the front of the child whereby a Halloween treat may be deposited into the hollow chute from the frontal position or by the child.

10 Claims, 2 Drawing Sheets

HALLOWEEN BACKPACK

CROSS REFERENCE TO RELATED APPLICATION

This application claims priority from United States Provisional Patent Application No. 60/036,631 filed Jan. 31, 1997 now abandoned titled Halloween Backpack.

Field of the Invention

This invention relates to the field of backpacks, and in particular to backpacks specifically adapted for use by children on Halloween night for the collection of Halloween treats.

BACKGROUND OF THE INVENTION

It is well known that on Halloween night, children are out on the streets running from door to door to collect treats. Often children will collect treats in bags or the like which must be manually carried. Sometimes children are also provided with flashlights or other illuminated safety devices which must also be carried. Applicant has observed that often, as the bag of treats becomes heavier, a child will put away or discard manually carried safety devices in favour of carrying the increasingly heavy bag of treats. Further, in colder climates, the streets are often icy on Halloween night and thus it increases the safety hazard to have a child's hands fully occupied.

Consequently, it is an object of the present invention to provide a means for a child to collect Halloween treats without having to manually carry a bag or the like, thereby freeing the child's hands for carrying flashlights, light wands, or the like in one hand while keeping the other hand free for stability on icy roads and walk paths.

Applicant is aware of U.S. Pat. No. 5,467,918 which issued to Glover on Nov. 21, 1995 for a controlled access collection container. Glover discloses a collection container for Halloween treats. The container is manually carried by a child. The container is a hollow lightweight receptacle where the opening to the receptacle is a generally cylindrical chute. The chute has a controlled access so that a child may deposit treats into the container but may not easily remove the treats from the container, the object being that the treats are taken from the container in the presence of a supervising adult. The Glover teaching does not provide for carrying the container in the manner of a backpack, nor does it suggest forming a chute so as to provide an over-the-shoulder passageway for delivery of treats into the backpack container as in the present invention.

SUMMARY OF THE INVENTION

In summary, the Halloween backpack of the present invention comprises in one aspect, a hollow container having an outer surface adapted to be worn as a backpack on the back of a child, means such as straps for releasable mounting of the hollow container on the back of the child, a hollow chute mounted onto the outer surface of the hollow container, the chute defining a passageway along the chute between a frontal chute opening in the chute and an aperture in the outer surface of the hollow container thereby forming a cooperating passageway, sized to accept Halloween treats therethrough, cooperating between the frontal opening and a holding cavity in the hollow container.

The hollow chute extends upwardly of the hollow container so as to extend above a shoulder of the child when the child is wearing the hollow container as a backpack. The hollow chute is shaped to present the frontal chute opening for access from a frontal position facing the front of the child whereby a Halloween treat may be deposited into the hollow chute from the frontal position or by the child. The hollow chute, rather than being mounted onto the hollow container, may be formed as a unitary part of the hollow container.

Advantageously, the chute extends upwardly from the hollow container so that the passageway forms a curved passageway over the shoulder and the frontal chute opening is generally vertical and adjacent the child's head. Further advantageously, mounting means are provided for mounting a light source or light reflective device onto the outer surface of the hollow container.

DETAILED DESCRIPTION OF THE PREFERRED EMBODIMENT

Figure 2:
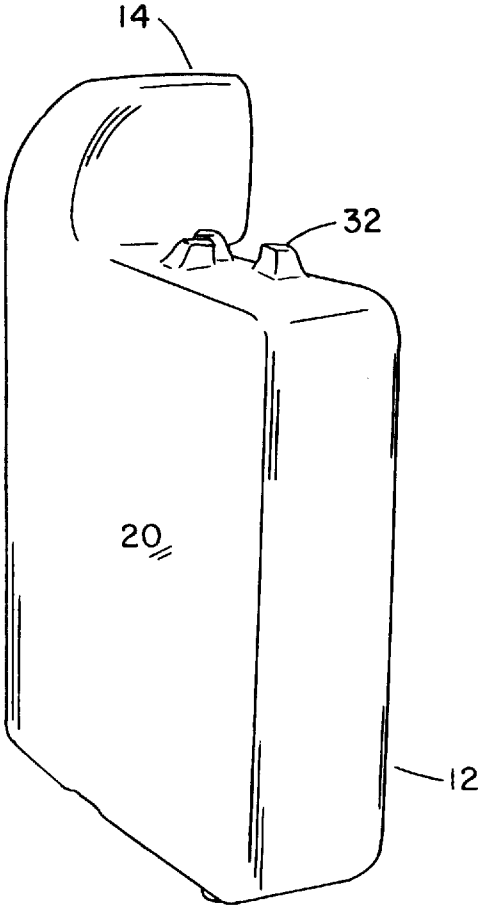
FIG. 2 is, in rear perspective view, the Halloween backpack of FIG. 1.
Figure 1:
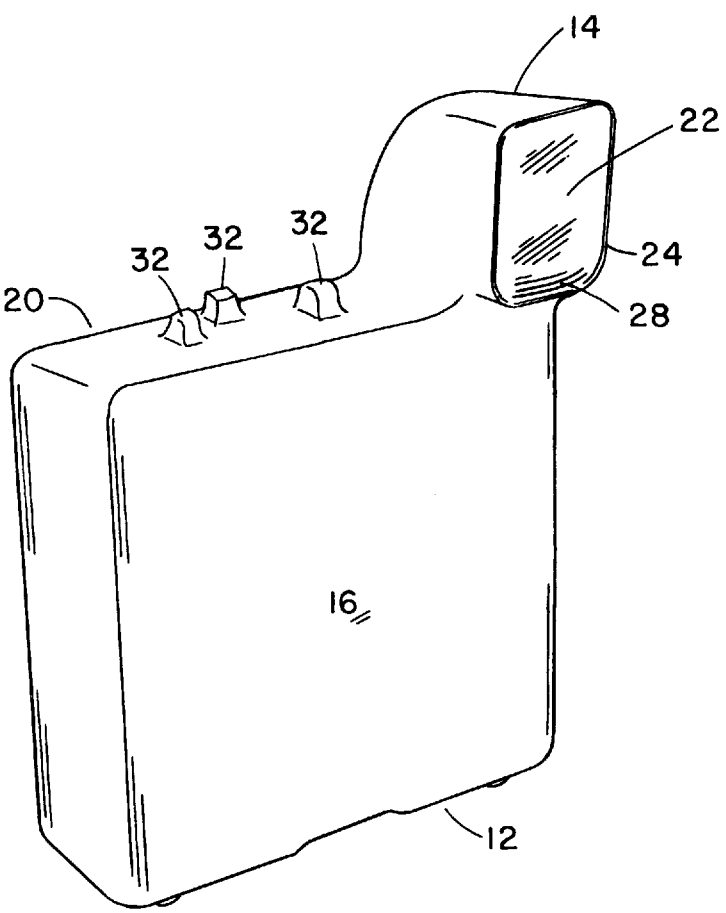
FIG. 1 is, in front perspective view, the Halloween backpack of the present invention, without a fanciful cover.
Figure 3:
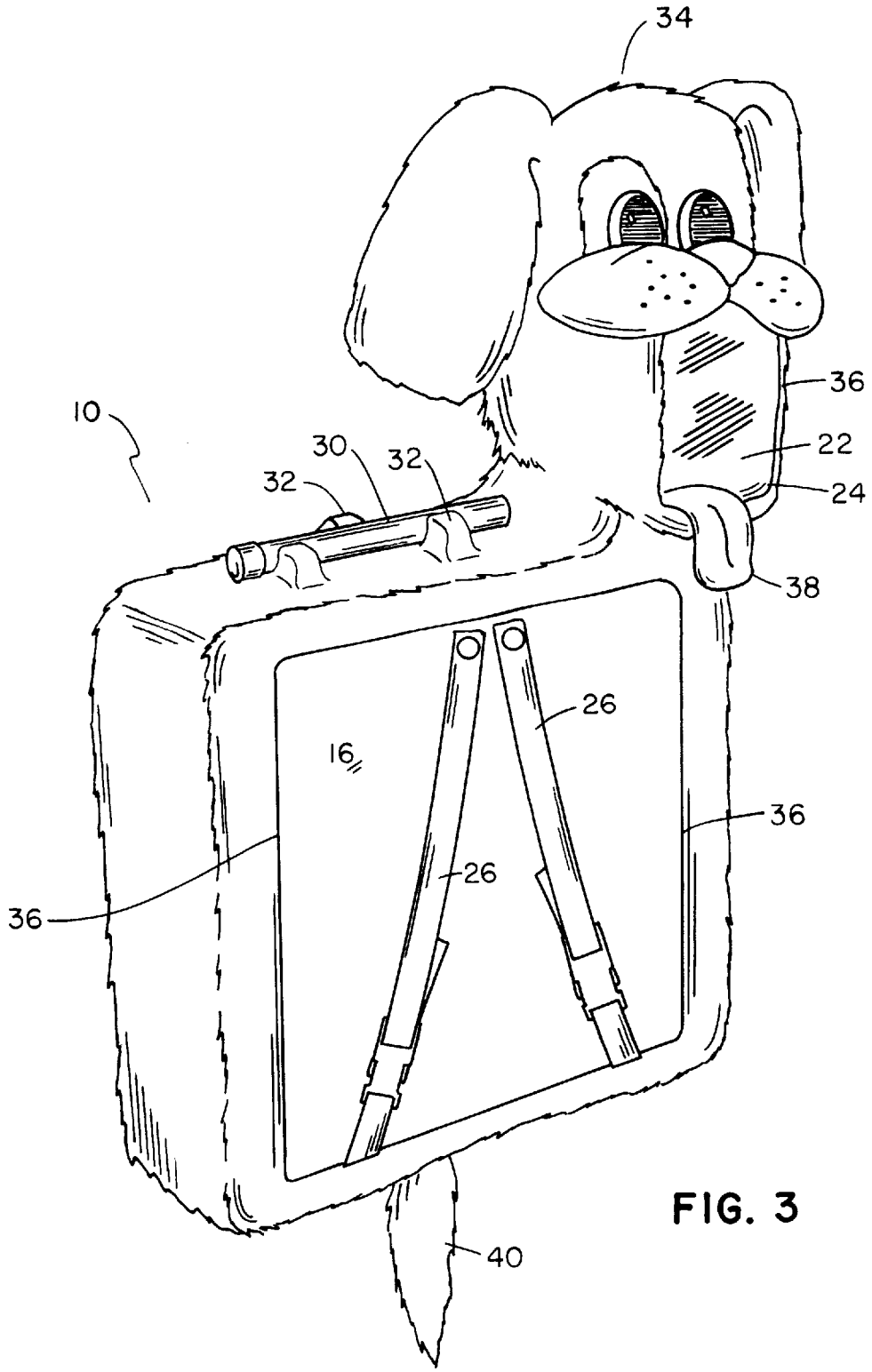
FIG. 3 is, in front perspective view, the Halloween backpack of FIG. 1, with a fanciful cover mounted thereon.

As illustrated in FIGS. 1–3, the Halloween backpack 10 of the present invention has a hollow container 12. An upper chute 14 cooperates therewith. Hollow container 12 has face 16 which is either flat or concave so as not to be uncomfortable when worn against the back of a child(not shown). Contiguous to face 16 is shell 20, which may be a fanciful three dimensional design, such as the pumpkin shape, or generally rectangular as illustrated. Shell 20 and face 16 define a cavity into which may be deposited Halloween treats by means of chute passageway 22. Passageway 22 extends between an aperture in shell 20 at the base of chute 14 and a frontal opening 24. Chute 14 is rigidly mounted onto, or is formed as part of, shell 20, and extends from shell 20 upwardly and may be curved forwardly so as to position frontal opening 24 generally above the shoulder of a child when backpack 10 is being worn by the child by means of shoulder straps 26. Shoulder straps 26 may be releasably fastened by means of clasps (as shown), buckles, Velcro™, or the like. The depiction of straps 26 is not intended to limit in any way. It is understood that any means of wearing the backpack is intended within the scope of the invention. For example, the backpack may be formed as part of a coat or costume worn by a child. Further, if suitable for the fanciful design, two chutes may be provided one over each shoulder of the child, or perhaps one central elongate chute extending in a curved path from the backpack over the head of the child.

In the preferred embodiment, chute 14 curves in an arc upwardly and forwardly of an upper surface of shell 20 so that chute passageway 22 is generally downwardly curved from frontal opening 24 and frontal opening 24 presents a generally planar vertical entryway for ease of deposit of Halloween treats into chute passageway 22. The Halloween treats may thus slide on curved lower passageway surface 28 into hollow container 12.

In the preferred embodiment, as an added safety feature, a light source such as a fluorescent chemical tube 30, or a reflective strip, may be mounted on shell 20 by means of, for example, raised flanges 32, so as to be clearly visible, for example, by vehicles approaching from the rear.

Fanciful cover 34 may be sown or otherwise formed for snug fitment over shell 20 and/or chute 14. Fanciful cover 34 may be of any fanciful design, such as to complement a child's costume, secured onto shell 20 and chute 14 by means of elasticized edges 36 or other releasable fastening means. Preferably chute 14 supports a fanciful head design so that opening 24 may simulate a mouth. Tongue 38 may be sown onto the lower edge of cover 34 surrounding frontal opening 24 so as to protrude outwardly of the opening.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A Halloween backpack for a child comprising:

a hollow container having an outer surface, said hollow container adapted to be worn as a backpack on the back of a child, means for releasable mounting of said hollow container on said back of said child, a hollow chute mounted onto said hollow container, said chute defining a passageway along said chute between a frontal chute opening in said chute and an aperture into said hollow container thereby forming a cooperating passageway between said frontal opening and a holding cavity in said hollow container, said chute opening, said passageway, and said aperture sized to accept Halloween treats said chute being formed of a shape retaining material such that the shape of said frontal chute opening remains constant, said chute extending upwardly of said hollow container so as to extend above a shoulder of said child when said child is wearing said hollow container as a backpack, said chute shaped to present said frontal chute opening for access from a frontal position facing the front of said child whereby a Halloween treat may be deposited into said hollow chute from said frontal position or by said child.

2. The device of claim 1 wherein said passageway forms a curved passageway over said shoulder, said frontal chute opening is generally vertical and adjacent the head of said child, and said means for releasable mounting of said hollow container on said back of said child are straps.

3. The device of claim 2 further comprising mounting means for mounting a light source or light reflective device onto said outer surface of said hollow container.

4. The device of claim 1 further comprising a fanciful cover, mounted onto said outer surface of said hollow container and said chute.

5. The device of claim 4 wherein said fanciful cover is, in part, shaped to simulate a head of an animal when mounted over said chute, a mouth of said animal corresponding to said frontal chute opening.

6. A Halloween backpack for a child comprising:

a hollow container having an outer surface, said hollow container adapted to be worn as a backpack on the back of a child, means for releasable mounting of said hollow container on said back of said child, a hollow chute formed as part of an upper surface of said hollow container, said chute defining, a passageway alone said chute between a frontal chute opening in said chute and a holding cavity in said hollow container, said chute opening, and said passageway, sized to accept Halloween treats said chute being formed of a shape retaining material such that the shape and size of said frontal chute opening remains constant, said chute extending upwardly of said hollow container so as to extend above a shoulder of said child when said child is wearing said hollow container as a backpack, said chute shaped to present said frontal chute opening for access from a frontal position facing the front of said child whereby a Halloween treat may be deposited into said hollow chute from said frontal position or by said child.

7. The device of claim 6 wherein said passageway forms a curved passageway over said shoulder, said frontal chute opening is generally vertical and adjacent the head of said child, and said means for releasable mounting of said hollow container on said back of said child are straps.

8. The device of claim 7 further comprising mounting means for mounting a light source or light reflective device onto said outer surface of said hollow container.

9. The device of claim 6 further comprising a fanciful cover, mounted onto said outer surface of said hollow container and said chute.

10. The device of claim 9 wherein said fanciful cover is, in part, shaped to simulate a head of an animal when mounted over said chute, a mouth of said animal corresponding to said frontal chute opening.

* * * * *